US009275566B2

(12) United States Patent
Andrascik

(10) Patent No.: US 9,275,566 B2
(45) Date of Patent: Mar. 1, 2016

(54) CUSTOM BUILT PORTABLE BILLBOARD

(71) Applicant: Visions Outdoor, LLC, Wayne, NJ (US)

(72) Inventor: Edward Andrascik, Wayne, NJ (US)

(73) Assignee: VISIONS OUTDOOR, LLC, Wayne, NJ (US)

( * ) Notice: Subject to any disclaimer, the term of this patent is extended or adjusted under 35 U.S.C. 154(b) by 0 days.

(21) Appl. No.: 14/212,727

(22) Filed: Mar. 14, 2014

(65) Prior Publication Data

US 2014/0259826 A1 Sep. 18, 2014

Related U.S. Application Data

(60) Provisional application No. 61/781,288, filed on Mar. 14, 2013.

(51) Int. Cl.

| | |
|---|---|
| ***G09F 21/04*** | (2006.01) |
| *G09F 13/02* | (2006.01) |
| *G09F 27/00* | (2006.01) |

(52) U.S. Cl.

CPC ..... *G09F 21/048* (2013.01); *G09F 21/04* (2013.01); *G09F 13/02* (2013.01); *G09F 27/00* (2013.01)

(58) Field of Classification Search

CPC ..... G09F 13/04; G09F 13/00; G09F 13/14; G09F 21/04; G09F 2013/0454

USPC ..... 40/541

See application file for complete search history.

(56) References Cited

U.S. PATENT DOCUMENTS

| | | | | | |
|---|---|---|---|---|---|
| 1,954,919 | A * | 4/1934 | Carey | 40/591 |
| 3,702,033 | A * | 11/1972 | Coleman | 40/541 |
| 4,185,288 | A * | 1/1980 | Dosch et al. | 343/765 |
| 4,626,017 | A * | 12/1986 | Robertson | 296/3 |
| 4,643,476 | A * | 2/1987 | Montgerard | 296/24.32 |
| 4,773,521 | A * | 9/1988 | Chen | 198/302 |
| 5,058,299 | A * | 10/1991 | Suzuki | 40/603 |
| 5,507,109 | A * | 4/1996 | Rinzler | 40/603 |
| 5,918,924 | A * | 7/1999 | Cowan | 296/21 |
| 6,101,751 | A * | 8/2000 | Hicks | 40/590 |
| 6,145,230 | A * | 11/2000 | Holmberg | 40/591 |
| 6,250,002 | B1 * | 6/2001 | Wittenberg | 40/603 |
| 6,598,327 | B1 * | 7/2003 | Strzeletz | 40/591 |
| 6,678,981 | B1 * | 1/2004 | Shoen et al. | 40/591 |
| 6,782,646 | B1 * | 8/2004 | Devaney | 40/590 |
| 6,904,709 | B2 * | 6/2005 | Craig et al. | 40/590 |
| 7,275,340 | B2 * | 10/2007 | Andrews et al. | 40/590 |
| 7,635,010 | B1 * | 12/2009 | Manno et al. | 141/86 |
| 8,037,629 | B2 * | 10/2011 | Harris | 40/594 |
| 8,188,845 | B2 * | 5/2012 | Abernethy et al. | 340/425.5 |
| 8,220,854 | B2 * | 7/2012 | Cohen et al. | 296/21 |
| 8,418,386 | B1 * | 4/2013 | Key et al. | 40/590 |
| 2003/0213156 | A1 * | 11/2003 | Gregory | 40/661 |

(Continued)

*Primary Examiner* — Shin Kim

(74) *Attorney, Agent, or Firm* — Gearhart Law, LLC

(57) ABSTRACT

The present disclosure provides for a customizable, portable billboard system. The portable billboard has a number of sidewalls enabling advertisement graphic placement. These sidewalls sit upon a support base that has structures, preferably wheels, which help to facilitate movement of the billboard. The advertisement graphical overlay is attached to the sidewalls via framing that surrounds the perimeter of each of the sidewalls. The entire system is self-contained and has a generator to power any lights or speakers or the like that may be required. The system has a hitch attachment so that it may be easily maneuvered or transported to a particular location by motor vehicle.

17 Claims, 10 Drawing Sheets

(56) References Cited

U.S. PATENT DOCUMENTS

2004/0080149 A1* 4/2004 Martin ..... 280/769
2010/0043264 A1* 2/2010 Johnson, Jr. ..... 40/559
2011/0316298 A1* 12/2011 Rampersad ..... 296/21
2013/0099519 A1* 4/2013 Cohen et al. ..... 296/21
2014/0259826 A1* 9/2014 Andrascik ..... 40/541

* cited by examiner

CUSTOM BUILT PORTABLE BILLBOARD

CLAIM OF PRIORITY

This application claims the priority of U.S. Application Ser. No. 61/781,288 filed on Mar. 14, 2013, the contents of which are fully incorporated herein by reference.

FIELD OF THE INVENTION

The field of the invention relates to portable advertisements, namely billboards that can readily be moved to varying locations as needed. In particular, to a portable custom built billboard that is integrated with a wheeled trailer and can be assembled and disassembled in a minimal amount of time.

BACKGROUND OF THE INVENTION

Advertising is a manner of generally promoting a product or business via varying mediums urging consumers to take or continue to take a particular action. Advertisements are typically manifested through radio, television, print, internet, product placement, and billboard amongst many others. Billboards are large advertisements present usually in outdoor space. These large "signs" are placed in high traffic (foot or automobile) areas to generate a maximum consumer exposure. As such, this type of advertising is immensely popular in urban areas. The overarching purpose behind these advertisements is to quickly generate an impression in a consumer that lasts after the consumer has passed the billboard. However, conventional billboards do have their drawbacks.

Conventional billboards are inherently stationary. Thus, they rely on the consumer to pass them in order for them to be effective. They cannot be used to bring advertising to the consumer. In some instances, billboards are subject to a number of laws and are even outlawed in some states. As a result, various types of mobile billboards have been created. Some of these billboards are driven on trailers or trucks through traffic, while others can be towed behind bicycles. While effective to a degree, these types of billboards are not permanent and are constantly on the go. Thus there is a need for a billboard that breaches the gap between stationary and mobile billboards.

The present invention meets and exceeds these needs. The present invention provides for a customized, portable billboard that can be readily relocated to any desired area. Once delivered, the billboard is set up and upon completion of set up appears to be a billboard that is integral with the area. The billboard can remain for as long as the customer would chooses and may be moved at different times quickly and easily to take advantage of different traffic patterns at the same or different locations.

Thus, various devices are known in the art. However, their structure and means of operation are substantially different from the present disclosure. The other inventions also fail to solve all the problems taught by the present disclosure. The present invention is fully customizable and made to order for the customer. The particular specifications are not tied to any existing structure or previously used structure. At least one embodiment of this invention is presented in the drawings below and will be described in more detail herein.

SUMMARY OF THE INVENTION

The present disclosure describes and teaches a portable signage system having a wheeled signage base having a base support and a ground support; at least one sidewall, wherein the base support has a support surface that supports the at least one sidewall, and wherein the at least one sidewall has a top edge, a bottom edge, and two side edges; a signage support frame extending along at least two of the top edge, the bottom edge, or either of the two side edges of the at least one sidewall; and at least one signage panel affixed to the at least one sidewall by way of the signage support frame.

In another embodiment of the present invention there is portable signage system having a wheeled signage support with a base support, four sidewalls, and a top wall, wherein the base support has a support surface that supports the four sidewalls, wherein the four sidewalls have a top edge, a bottom edge, and two side edges, and wherein the four sidewalls are joined along each of the two side edges and the top wall is joined to each of the four sidewalls along the top edge of each sidewall defining a cavity within; a plurality of signage support frames extending from about the top edge to about the bottom edge of each of the four sidewalls; at least one signage panel affixed to the any of the four sidewalls by way of the signage support frame; a generator placed within the cavity; at least one lighting mechanism coupled to the generator that enhances the visibility of the at least one signage panel; and at least one sound emitting device coupled to the generator.

Generally, the portable signage system manifests itself in a tow behind trailer. This enables for quick and easy delivery, as well as permitting greater latitude to the position of display. Once the trailer structure is positioned, the custom built portable signage can be assembled. There are a number of support structures that provide a foundation for attachment of varying structural items. For example, across each of the sidewalls is a plurality of signage support frames. These frames are spaced as to evenly divide the sidewall surface into individual sections to which the portable signage panels can be adhered. The adherence may be achieved a number of ways depending on the particular signage material used for the job. Additionally, there are support channels for the protective skirt which surrounds the lower portion (beneath the signage panels) to mask and protect the undercarriage of the trailer structure.

In order to properly stabilize the underlying trailer structure and prevent the signage display from tipping over and damaging the structure or causing injury, there are a number of hinged support legs that extend downward from the trailer structure to the about the ground level. These support legs are coupled to the display structure and will aid in keeping the structure upright under inclement conditions or in the event of a loss of stability. There may be cross beams that extend between the support legs to help prevent the side to side movement or back and forth movement of the support legs. To further complete the set up, columns may cover part of the supporting structures.

In general, the present invention succeeds in conferring the following, and others not mentioned, benefits and objectives.

It is an object of the present invention to provide a portable billboard that can be used to directly target consumers.

It is an object of the present invention to provide a portable billboard that is fully customizable to customer specifications.

It is an object of the present invention to provide a portable billboard that has a minimal set up and tear down time.

It is an object of the present invention to provide a portable billboard that enhances the visual display of the billboard with the addition of lighting and sounds.

It is an object of the present invention to provide a portable billboard that once set up appears to be a permanent structure.

It is another object of the present invention to provide a portable billboard that can be towed and positioned by a motor vehicle.

It is another object of the present invention to provide a portable billboard that aids in increasing client revenue.

It is another object of the present invention to provide a portable billboard that is a self contained unit and requires no external power sources.

It is another object of the present invention to provide a portable billboard that has multiple advertising facets.

It is yet another object of the present invention to provide a portable billboard that can display multiple images.

DETAILED DESCRIPTION OF THE DRAWINGS

Figure 1:
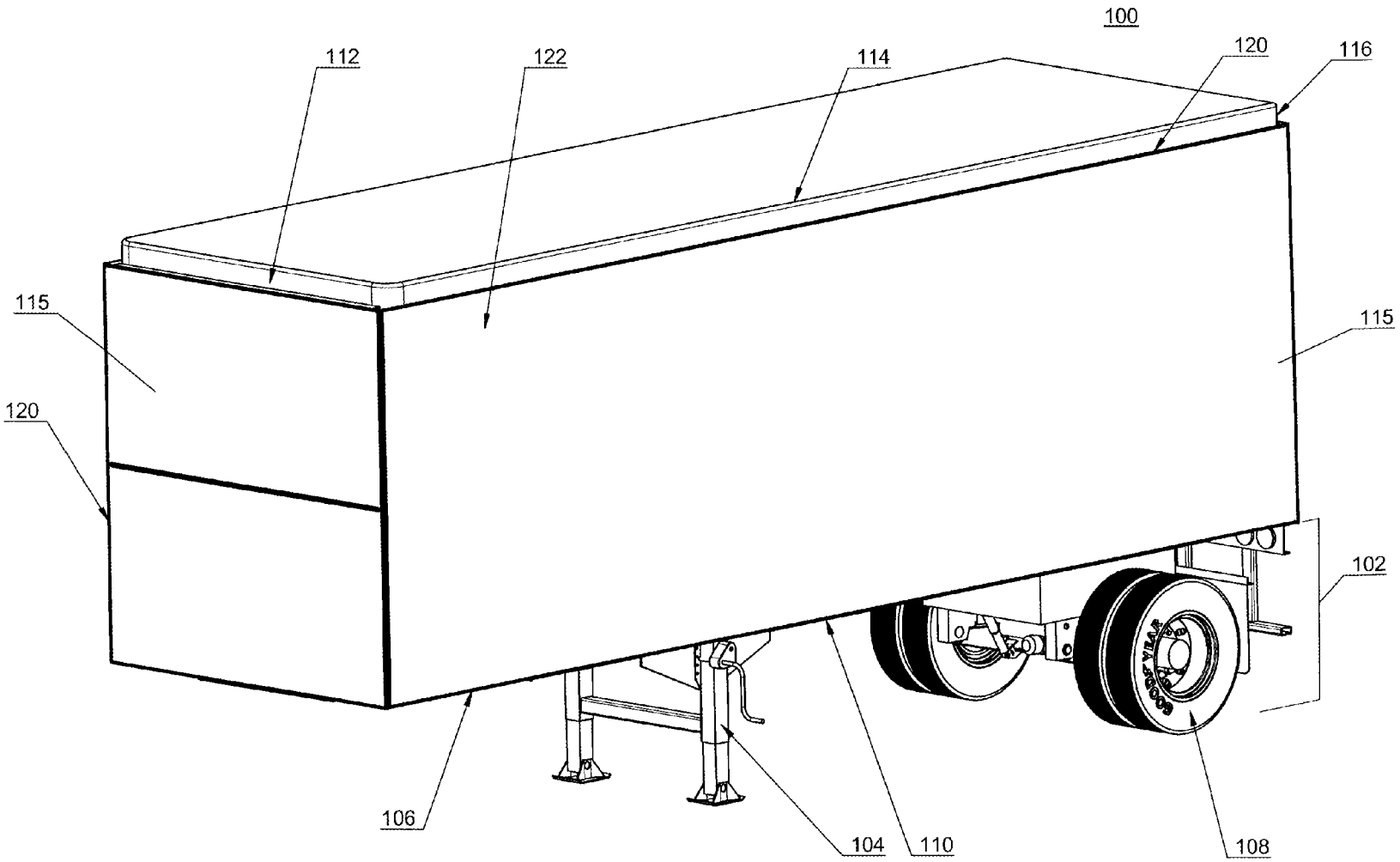
FIG. 1 is a perspective view of the present invention in a disassembled, or transport, form.

The preferred embodiments of the present invention will now be described with reference to the drawings. Identical elements in the various figures are identified, as far as possible, with the same reference numerals. Reference will now be made in detail to embodiments of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto without deviating from the innovative concepts of the invention.

Referring to FIG. 1, there is a perspective view of a portable signage system 100 in a disassembled, transportable form. The portable signage system 100 has two distinct areas: the wheeled signage base 102 and the sidewalls 112. The wheeled signage base 102 has at least one wheel 108 and preferably more than one wheel 108. The number of wheels 108 may vary depending on the overall size and weight of the portable signage system 100. The wheeled signage base 102 has at least one ground support 104. The ground support 104 is extendable to compensate for the variable surface conditions where the portable signage system 100 is positioned. The ground supports 104 may be extendable by way of, but not limited to, a crank system, pin system, or hydraulic system. The base support 106 is attached to the wheels 108 and the ground support 104. The base support 106 provides a base for the sidewall(s) 112 to be secured.

Any of a number of sidewalls 112, which may range from 1-10 and more typically 1-4 sidewalls, are attached to the support base 106 and have generally common features. Typically, each of the sidewalls 112 has a top edge 114, a bottom edge 110, and at least two side edges 116. These edges border the sidewall surface 115. The sidewall surface 115 has a signage support frame 120 attached thereto. The signage support frame 120 may be attached to directly to the edges of the sidewalls 112 or may be located more internally on the sidewall surface 115. The signage support frame 120 comprises generally U-shaped channels that are adhered to the sidewall surface 115. A signage panel 122 is positioned to be held by these channels thereby securing the signage panel 122 to the sidewall surface 115. The exact configuration of the signage support frames 120 may vary. This customized flexibility enables a wide variety of shapes and sizes of signage panels 122 to be quickly and easily interchanged. For example, there may be a vertical panel flanked on three sides by signage support frames 120 with the top side left open for easy access. Next to the vertical panel, could be two horizontal panels one positioned above the other and each flanked on the top and bottom by support frames 120. In some configurations, the signage support panels 122 and signage support frames 120 extend above the top edge 114 of the sidewall 112.

Figure 2:
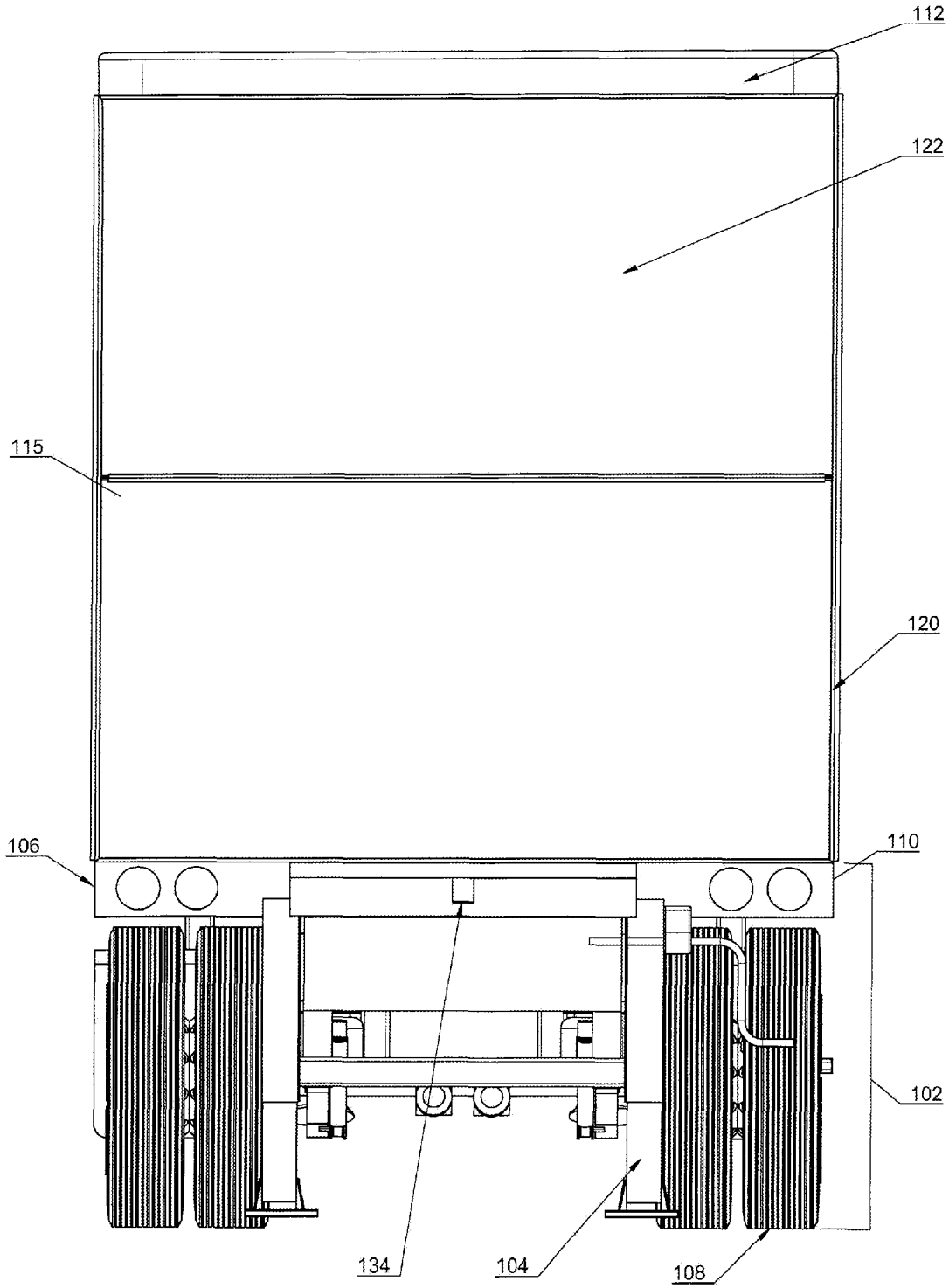
FIG. 2 is a front view of the front of the portable signage display of the present invention.

In FIG. 2, there is a front view of the portable signage display 100. The front sidewall is the sidewall 112 located closest to the hitched connector 134. The hitched connector 134 is used to transport the portable signage display 100. The hitched connector 134 enables the portable signage display 100 to be coupled to a motor vehicle and transported distances or positioned. As shown, each of the sidewalls 112 may have any component of the signage support frame 120. The front sidewall has only a "partial" signage support frame 120. Here, the signage support frame 120 is shown as sectioning the sidewall 112 into two different portions whereby two different signage panels 122 or two signage panels 122 bearing a complementary image may be positioned.

Figure 3:
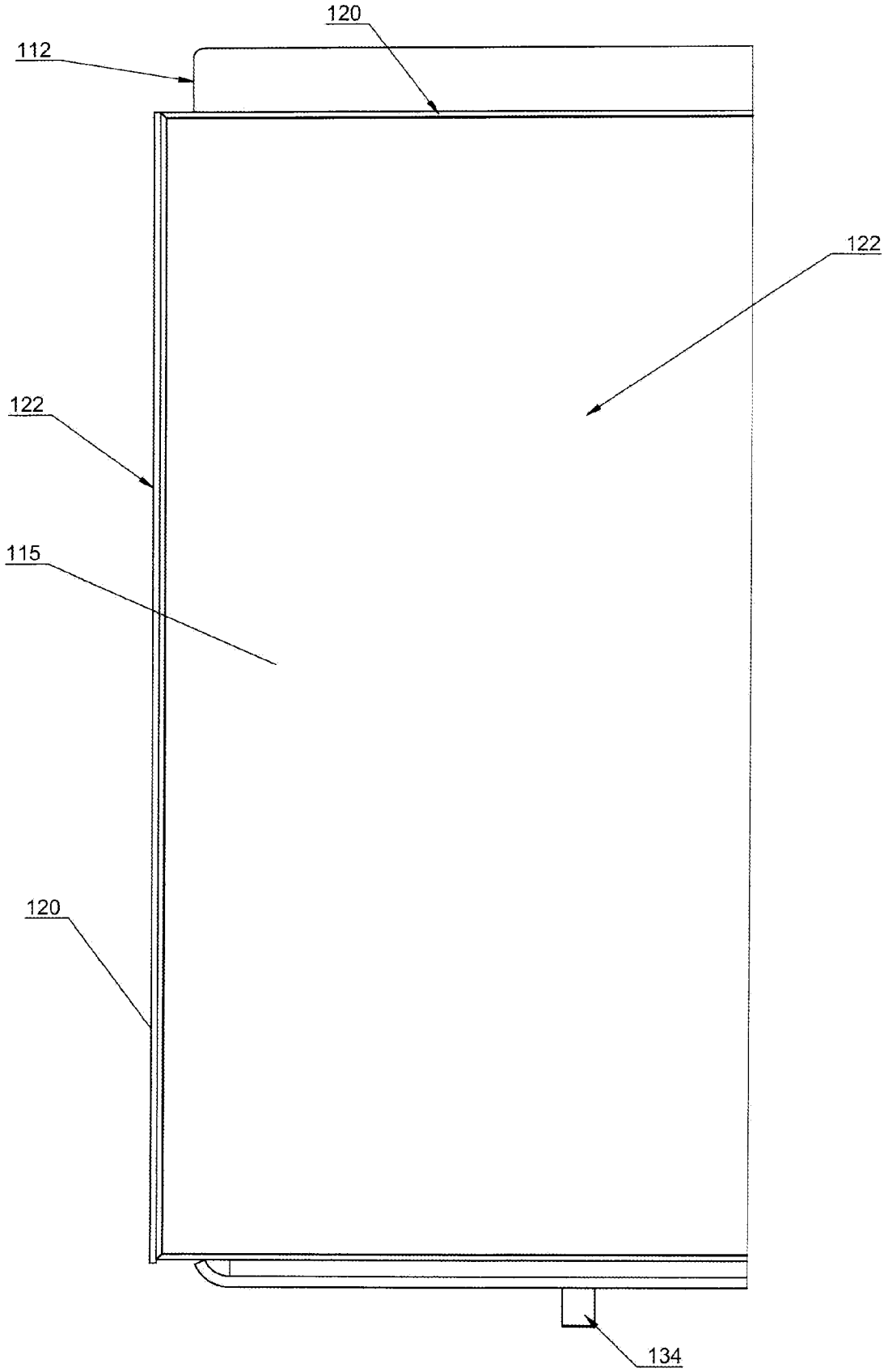
FIG. 3 is a side view of the front of the portable signage display.

In FIG. 3, there is a side view of the front of the portable signage system 100. The sidewall 112 and sidewall surface 115 are shown as a foundation for the signage support frame 120. Here, the signage support frame 120 is shown surrounding and supporting the signage panel(s) 122. From this view, taken from the side, the front end of the portable signage support system 100 shows the structural features of the front end. Further, there is a hitched connector 134 located below the front end. The hitched connector 134 enables the portable signage system to be hitched to a motor vehicle for transportation and positioning purposes.

Figure 4:
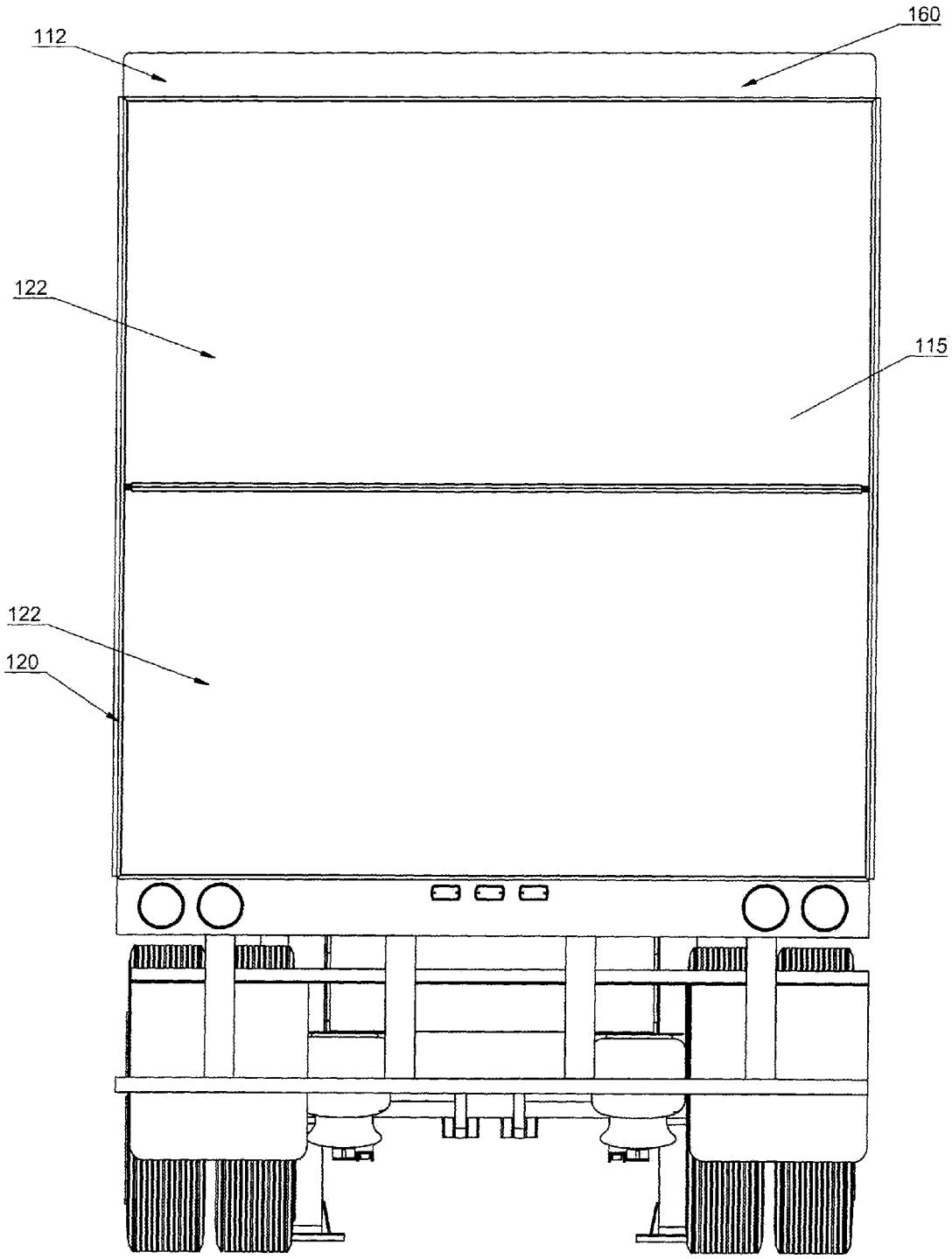
FIG. 4 is a front view of the back of the portable signage display.
Figure 5:
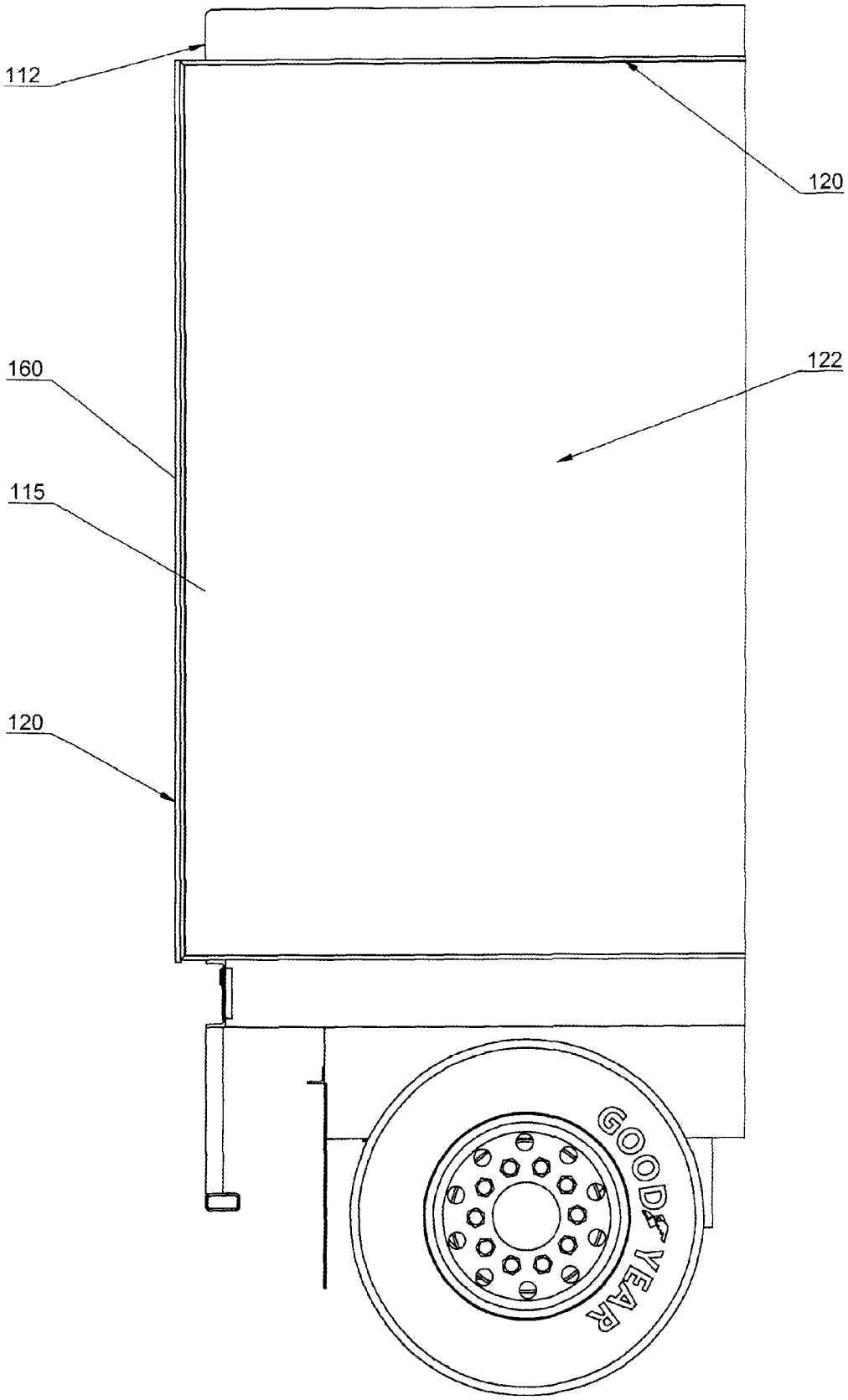
FIG. 5 is a side view of the back of the portable signage display.

In FIG. 4, there is a front view of the back of the portable signage display. The back of the portable signage display is similar to the front of the signage display. Here there is a sidewall 112 with a sidewall surface 115. There is a signage support frame 120 positioned along the bottom edge, top edge, and down the middle of the sidewall 112. This signage support frame 120 enables a signage panel 122 to be positioned therein. Additionally, there is an access door 160 that comprises a portion of the sidewall 112. The access door 160 provides access to the cavity 140 (see FIG. 9) located within the sidewalls 112. Here, support structures, panels, generators, and the like can be stored during transportation or to help prevent the theft of items. The access door 160 preferably has a lock or coded mechanism in order to permit entry to the contents therein. The access door 160 is accessed by removing the signage panels 122 and opening the door which may be on rollers, hinges, or the like. FIG. 5 shows the same sidewall 112 but from a side view. The signage support frames 120 are shown and in at least one instance shown to support a signage panel 122.

Figure 6:
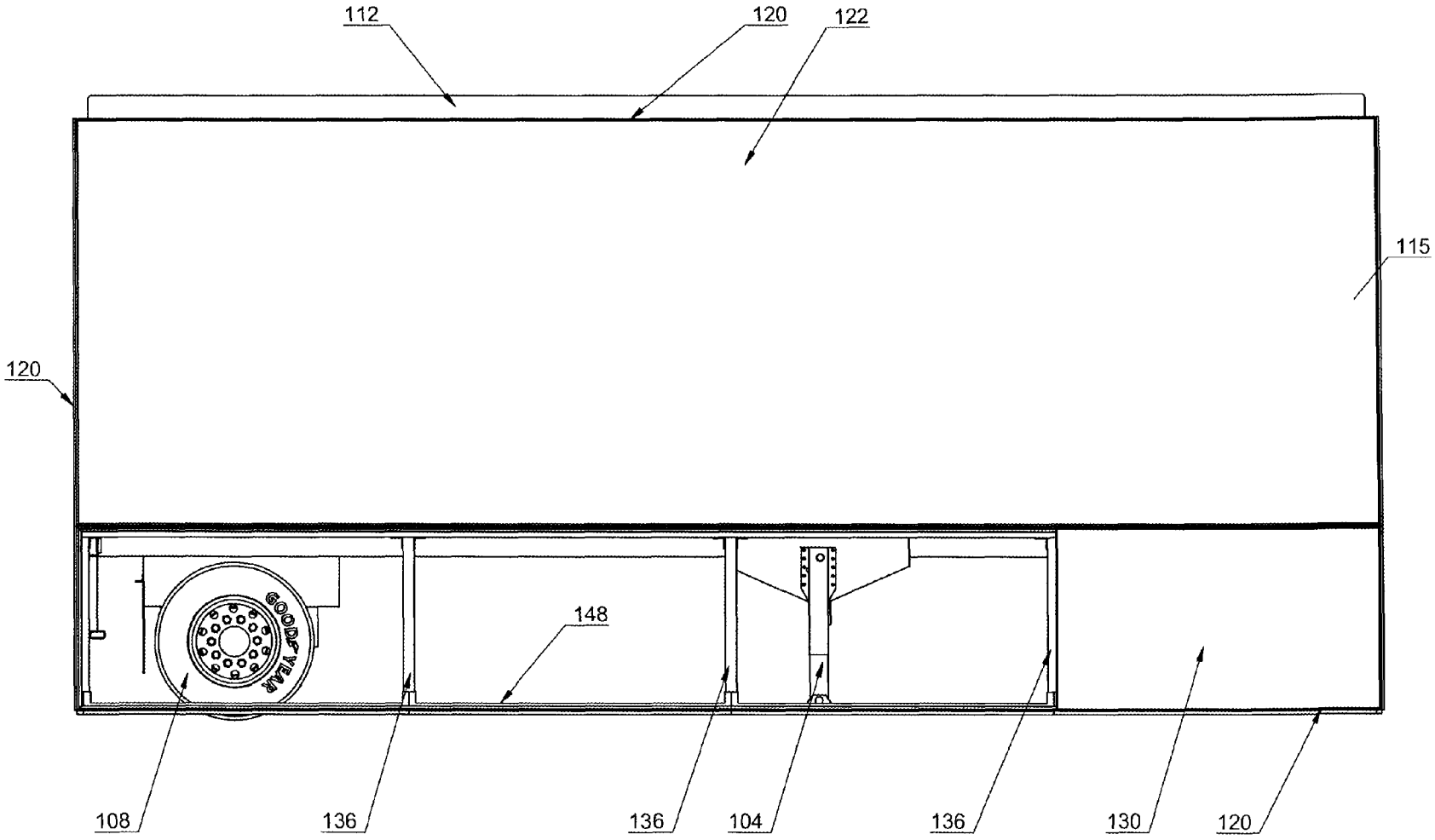
FIG. 6 is a front view of a side of the portable signage display.

In FIG. 6, the portable signage system 100 is shown from a side view and is shown in a partially assembled form. The signage support frame 120 is shown bordering the edges of the sidewall 112. The signage support frame 120 is positioned on the sidewall surface 115. The signage panel 122 may be placed within the bounds of the signage support frame 120. There may be multiple signage support panels 122 depending on the size of the advertisement graphic and needs of the client and the configuration of the support frames 120. Below the sidewall 112 area is the support structures of the portable signage system 100.

Figure 10:
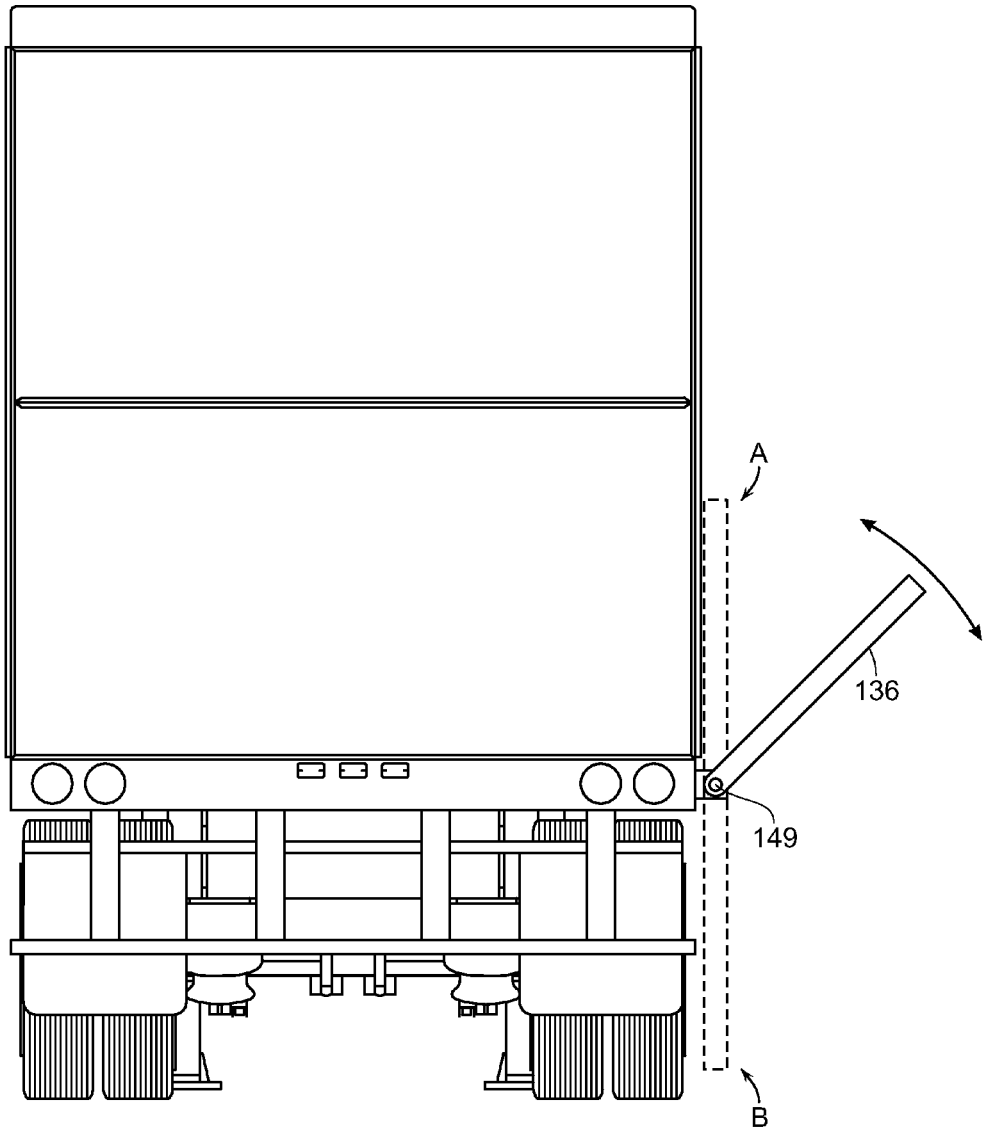
FIG. 10 is a back view of an embodiment of the present invention illustrating the rotatable nature of the skirt.

The supporting structures serve multiple purposes: to provide support and prevent shifts in the portable signage system and for ornamental purposes. The ground supports 104 and wheels 108 provide the foundation of contact between the system and the ground. Further, there are a plurality of supports posts 136 surrounding the exterior perimeter of the signage system. The support posts 136 are repositionable so that they may be hinged, rotated, or removed for separate transportation and storage configurations. As shown in FIG. 10, the support posts 136 are hinged and flip up or down (position A or position B as illustrated) depending on the desired position from their attached position 149 on the signage support system.

There may be a plate that reinforces the support posts 136 position on at least one end of the support post 136. The support posts 136 attach to the bottom of the sidewalls 112 or the sidewall surface 115 on one end, and to a support beam 148 on the other end. The support posts 136 are swung down from their storage position to their assembled position. The support beam(s) 148 run the length of each of the sidewalls 112. The support posts 136 and support beams 148 are positioned so that there is a slight distance between the ground upon which the signage system is sitting and the support beams 148.

The support beams 148 may be permanently adhered to the support posts 136 or may be required to be positioned upon proper positioning of the support posts 136. As stated above, the support beams 148 and support posts 136 extend towards the ground leaving a slight gap between the support beams 148 and the ground. This provides for variances in the level of the ground, as well as providing for slight shifts of the system without damaging the system. The support beam 148 further has a channel that is integral to the shape and structure of the support beam 148. The channel is substantially J-shaped. On the support beam 148, the J-shaped channel is positioned so that the open area of the channel is facing upwards. There may also be a similar channel situated directly above the channel of the support beam 148. The channel attached to the sidewall 112 is positioned so that the open area of the channel is facing downwards. This enables a skirt 130 to be positioned between and engaged to the support beam 148. The skirt 130 may comprise a single sheet for each length of sidewall 112 or multiple skirt panels may be needed. The skirt 130 has protective qualities as well as providing adding space or ornamental designs or advertising.

Figure 7:
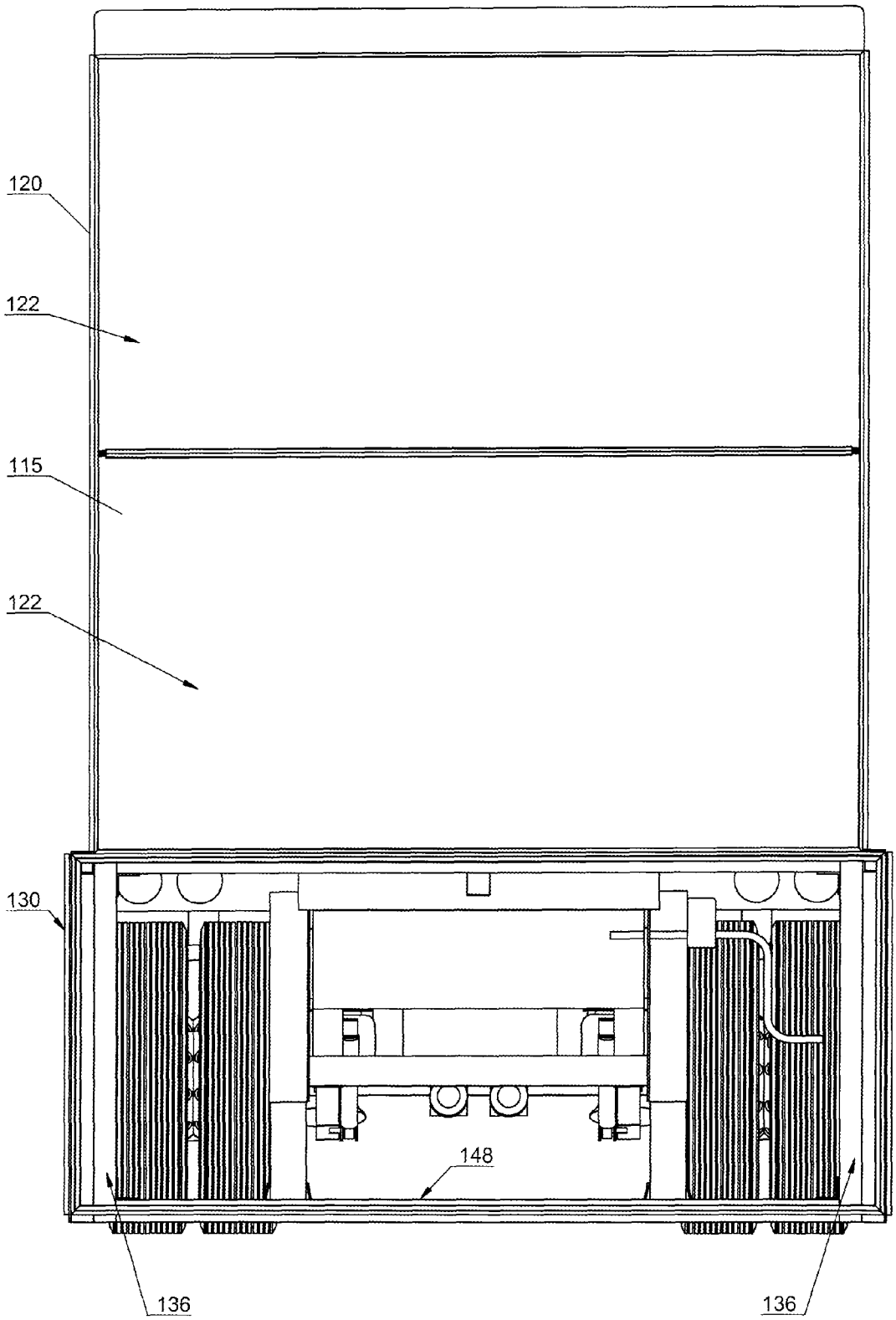
FIG. 7 is a front view of the portable signage display with skirt/support area partially assembled.

FIG. 7 shows a front view of the signage system with the support structures in place. The sidewall surface 115 is shown with the signage support frame 120 supporting a signage panel 122 thereon. There are a number of support posts 136 extending from the sidewall 112 and coupled to the support beam 148. The support posts 136 may be reinforced with plates on at least one end. On one side of the setup, the skirt 130 is positioned between and engaged to the support beam 148 demonstrating this structural interaction.

Figure 8:
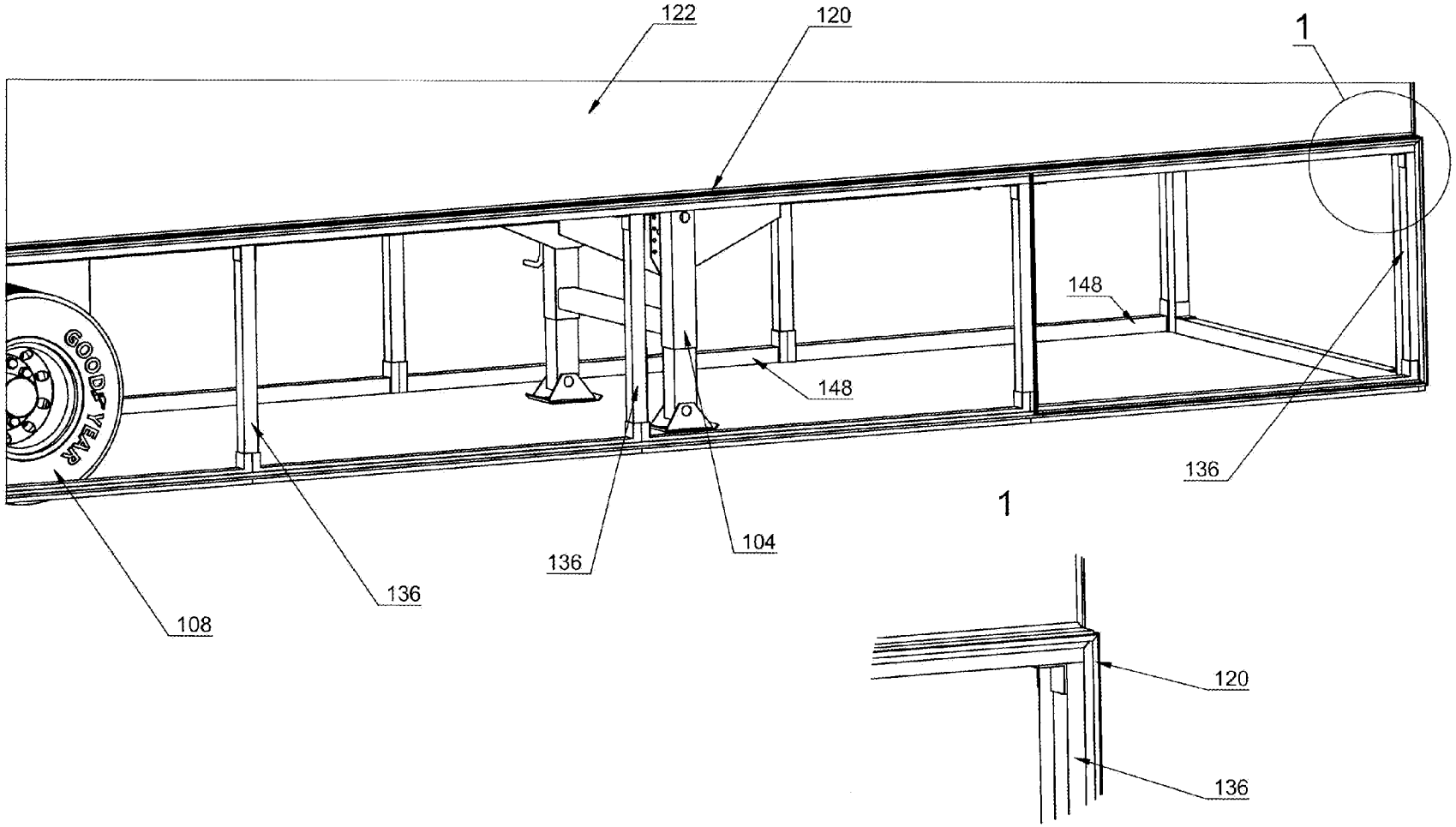
FIG. 8 is a perspective view of skirt/support area of the portable signage display.

In FIG. 8, there is a perspective view of the skirt/support area. Here, the support structures are readily visible. The wheels 108 and ground supports 104 are positioned to be in physical contact with the ground. The support posts 136 are been rotated downwards from their storage position and are secured in their assembled position. Each of the support posts 136 are positioned so that in the event of a shift of weight of the system, the support posts 136 will disperse the forces felt by the system and prevent a structural failure. The support beams 148 run substantially perpendicular to the support posts 136. The support beams 148 and, in some cases, the support posts 136 are shaped to receive elements such as the skirt 130 (see FIG. 9) or in some cases even additional signage panels. These structural features are shown in the highlighted area 1. Here, the integral structural mechanisms are apparent. In some cases, there are cross beams that extend horizontally between the support posts 136 to provide added foundational strength.

Figure 9:
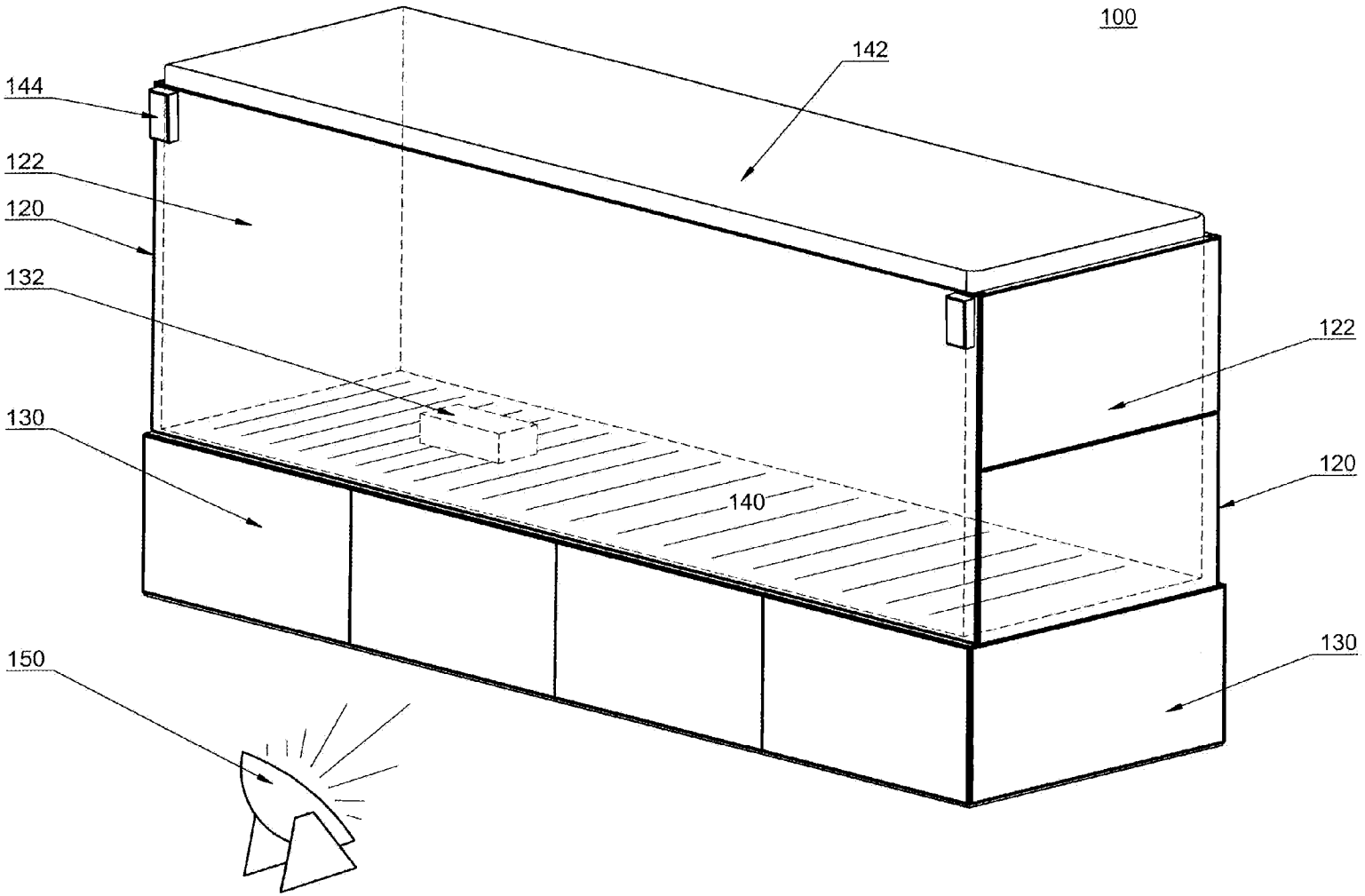
FIG. 9 is a perspective view of the portable signage display fully assembled as intended.

FIG. 9 demonstrates a portable signage system 100 fully assembled. The portable signage system 100 has a number of signage panels 122 secured by signage support frames 120. The signage panels 122 may bear words, names, logos, colors, images, and the like or any combination thereof. The options are virtually limitless and only limited by the imagination. Below the signage panels 122, the skirt 130 is positioned. The skirt 130 is affixed to the undercarriage structure (see FIG. 8) and protects the signage system 100 from weight shifts and vandalism or damage. The skirt 130 may comprise the same or different material as the signage panels 122. Additionally, the skirt 130 may be customized to help give the signage system a "natural" appearance such as decorated with images of grass, rocks, and the like. Alternatively, the skirt 130 may provide a continued advertising surface. The signage system 100 is bound on all sides by sidewalls 112 and a top 142. The base support (see FIG. 1) provides the base of the structure. Internally, this leaves a cavity 140 wherein materials may be stored when not in use. Such materials may include signage panels 112 and skirt panels during transport and framing or electronic components that are to be included with the particular system.

Once assembled, the cavity provides to primarily house the generator 132 which provides power to the system namely for lighting and sound. Additionally, the generator 132 may provide for a number of other electronic devices to interact with the portable signage system 100 or potential viewers of the system 100. In some cases, it would be desirable that the generator can power wireless hotspots, provide for monitoring and/or tracking of users located in proximity to the system, and send communications through any number of mediums. In some instances, the generator 132 may be capable of locating users with a compatible electronic device that are in a particular proximity to the signage system 100. Through this proximity detection, users may be offered discounts via email, social media, text message, MMS, SMS, or the like or any combination thereof. Further, the generator 132 may power secondary devices such as laptop computers, PDAs, desktop computers, and the like or any combination thereof that can be used to interact with the signage system 100 to create particular audio, visual, or audiovisual displays.

The signage support system 100, fully assembled, may have a lighting mechanism 150 and speakers 144. The number of lighting mechanisms 150 and speakers 144 as well as the placement may vary depending on the particular needs at the time. In some instances, the lighting mechanism 150 and speakers 144 may be located externally in relation to the signage system 100 whereas in other they are integrated into the signage panels 122 or other structures. Overall, by the shape and design of the signage panels 122, framing, and skirt 130 are designed to serve as security measures making attempted theft of any of the components extremely difficult by limiting seams, crevices, and the like.

The signage panels 122 and framing (support posts 136, support beams 148, etc.) may comprise a number of materials including, but not limited to, plastics, metals, composites, resins, and the like or any combination thereof. Plastics used in construction of the signage system 100 may include polyethylene terephthalate (PET), polyethylene (PE), high-density polyethylene, polyvinyl chloride (PVC), polyvinylidene chloride (PVDC), low-density polyethylene (LDPE), polypropylene (PP), polystyrene (PS), high impact polystyrene (HIPS) and polycarbonate (PC), or any combination thereof. Composites may include but are not limited to fiber reinforced plastics, metal composites, carbon fiber, and Kevlar® and the like. Metals may comprise lightweight metals such as aluminum and other pure metals as well as various alloys.

What is claimed is:

1. A portable signage system comprising:

a wheeled signage base having a base support and a ground support;

at least one sidewall, wherein the base support has a support surface that supports the at least one sidewall, and wherein the at least one sidewall has a top edge, a bottom edge, and two side edges;

a signage support frame extending along at least two of the top edge, the bottom edge, or either of the two side edges of the at least one sidewall;

at least one signage panel affixed to the at least one sidewall by way of the signage support frame;

a rotatable skirt comprising a plurality of support posts rotatably coupled to the at least one sidewall, wherein the rotatable skirt extends along a perimeter of the base support and is sized to span approximately the distance between the perimeter and a surface upon which the wheeled signage support is resting, wherein each of the plurality of support posts extend from the base support to a bottom edge of the rotatable skirt; and at least one skirt panel secured to the rotatable skirt by at least one channel of the rotatable skirt.

2. The portable signage system of claim 1 wherein there are four sidewalls.

3. The portable signage system of claim 2 wherein there is at least one signage panel affixed to any combination of the four sidewalls.

4. The portable signage system of claim 1 wherein the ground support can be positioned at varying lengths thereby providing a stable support for the portable signage system.

5. The portable signage system of claim 1 further comprising audio, visual, or audiovisual capabilities.

6. The portable signage system of claim 1 further comprising a generator.

7. The portable signage system of claim 5 wherein lighting is used to enhance the at least one signage panel.

8. The portable signage system of claim 1 wherein the at least one signage panel extends above the top edge of the sidewall.

9. A portable signage system comprising:

a wheeled signage support having a base support and a ground support;

four sidewalls and a top wall, wherein the base support has a support surface that supports the four sidewalls, wherein the four sidewalls have a top edge, a bottom edge, and two side edges, wherein the top wall is coupled to the top edges of the four sidewalls;

a plurality of signage support frames extending along any combination of the top edge, the bottom edge, and the side edges of each of the four sidewalls;

at least one signage panel affixed to the any of the four sidewalls by way of the signage support frame;

a rotatable skirt comprising a plurality of extendable support posts, a plurality of support beams, and at least one skirt panel, the rotatable skirt extending along a perimeter of the base support and sized to span approximately the distance between the perimeter and the surface upon which the wheeled signage support is resting, wherein the extendable support posts are rotatably coupled to the four sidewalls, wherein the extendable support posts, when deployed, extend from the base support to a bottom edge of the rotatable skirt, and wherein the at least one skirt panel is secured by at least one channel of at least one of the plurality of support beams; and a lighting mechanism that enhances the visibility of the at least one signage panel.

10. The portable signage system of claim 9 further comprising a generator, wherein the generator supplies electrical power to the lighting mechanism.

11. The portable signage system of claim 9 wherein there is at least one signage panel affixed to each of the four sidewalls.

12. The portable signage system of claim 9 further comprising a hitched connector enabling the portable signage system to be coupled to and transported by a motor vehicle.

13. The portable signage system of claim 9 further comprising support posts located at the corners of the sidewalls of the portable signage system.

14. The portable signage system of claim 13 wherein at least one of the support posts is covered by an ornamental casing.

15. A portable signage system comprising:

a wheeled signage support having a base support and ground support;

four sidewalls, and a top wall, wherein the base support has a support surface that supports the four sidewalls, wherein the four sidewalls have a top edge, a bottom edge, and two side edges, and wherein the four sidewalls are joined along each of the two side edges and the top wall is joined to each of the four sidewalls along the top edge of each sidewall defining a cavity within;

a plurality of signage support frames extending along the top edge, bottom edge, and each of the side edges of each of the four sidewalls;

at least one signage panel affixed to the any of the four sidewalls by way of the signage support frames;

a rotatable skirt comprising a plurality of extendable support posts, a plurality of support beams, and at least one skirt panel, the rotatable skirt extending along a perimeter of the base support and sized to span approximately the distance between the perimeter and the surface upon which the wheeled signage support is resting, wherein the rotatable skirt obscures the wheeled signage support, wherein the plurality of extendable support posts extend from the base support to a bottom edge of the rotatable skirt; and wherein the at least one skirt panel is coupled to the rotatable skirt by at least one channel of at least one of the plurality of support beams;

a generator placed within the cavity;

at least one lighting mechanism coupled to the generator that enhances the visibility of the at least one signage panel; and at least one sound emitting device coupled to the generator.

16. The portable signage system of claim 15 wherein the lighting mechanism and the sound emitting device operate in conjunction with or independent from one another.

17. The portable signage system of claim 15 wherein there are a plurality of lighting mechanisms.

* * * * *